US005077951A

United States Patent [19]

Baker

[11] Patent Number: 5,077,951

[45] Date of Patent: Jan. 7, 1992

[54] SUSPENDED CEILING SYSTEM

[75] Inventor: Robert F. Baker, Dallas, Tex.

[73] Assignee: Baker Metal Products, Inc., Dallas, Tex.

[21] Appl. No.: 607,043

[22] Filed: Oct. 31, 1990

[51] Int. Cl.[5] ..... E04B 9/18; E04B 9/26

[52] U.S. Cl. ..... 52/484; 52/488; 52/489; 52/106; 52/764

[58] Field of Search ..... 52/489, 488, 484, 106, 52/764, 773

[56] References Cited

U.S. PATENT DOCUMENTS

| | | | |
|---|---|---|---|
| 2,481,794 | 2/1945 | Stitt | 52/773 |
| 3,089,570 | 5/1963 | O'Neil | 52/764 |
| 3,216,537 | 5/1966 | Nelsson | 52/484 |
| 3,590,544 | 7/1971 | Shepherd | 52/484 |
| 4,408,428 | 10/1983 | Brook et al. | 52/489 |
| 4,479,341 | 10/1984 | Schuplin | 52/489 |
| 4,937,994 | 7/1990 | Ritter | 52/484 |

*Primary Examiner*—Richard E. Chilcot, Jr.
*Assistant Examiner*—Robert Canfield
*Attorney, Agent, or Firm*—Fitzpatrick, Cella, Harper & Scinto

[57] ABSTRACT

A suspended ceiling system has a plurality of main-tee beams and cross-tee beams assembled to form a grid system. Ceiling panels are installed within grid openings in the grid system. A retaining clip is used to secure the ceiling panels and the cross-tee beams to the main-tee beams. Panel clips can also be used to secure the ceiling panels to the cross-tee beams.

19 Claims, 6 Drawing Sheets

SUSPENDED CEILING SYSTEM

BACKGROUND OF THE INVENTION

1. Field of the Invention

This invention relates in general to a ceiling system, and more particularly to a suspended ceiling system that is easy to install and provides high security ceiling panels which cannot be removed from below.

2. Description of the Prior Art

Suspended ceilings are well known in the art, as are so called security ceiling systems designed to prevent removal of the ceiling panels from below. Security ceiling systems are commonly used in jails, detention centers and other types of correctional facilities to prevent penetration through the ceiling system by removal or loosening of the ceiling panels. Properly secured ceiling panels prevent access through the ceiling panels to possible escape routes and also prevent inmates from hiding items such as weapons within cracks or joints between the ceiling panels.

One type of known security ceiling system uses a plurality of contour clips secured to a series of parallel-spaced channels. The contour clips have a v-shaped notch for receiving and securing snap bars, which are disposed perpendicularly to the channels to form a ceiling grid. Ceiling panels are snap-fitted into the snap bars in a non-removable fashion to complete the ceiling system.

In other types of known ceiling systems, a ceiling grid system is formed by securing secondary runners, or beams, to perpendicularly placed primary beams. Ceiling panels are placed in the ceiling grid and secured to the secondary beams by security clips. The security clips are conventionally threaded through holes in the ceiling panels and designed for a contour fit over the secondary beams.

Conventional security ceiling systems generally have a grid system with primary and secondary beams secured to each other with one set of brackets or clips and ceiling panels secured to the secondary beams with another set of brackets or clips. The drawbacks of these ceiling systems include additional assembly steps and the ease with which the ceiling panels can be removed or knocked ajar from the secondary beams.

SUMMARY OF THE INVENTION

Accordingly, it is an object of this invention to provide a suspended ceiling system which effectively prevents removal of the ceiling panels from below.

It is another object of the invention to provide a suspended ceiling system which effectively prevents shifting or loosening of the ceiling panels from below.

It is yet another object of the invention to provide an easy to assemble ceiling system designed to provide components which can be secured together with a single type of locking clip.

In one aspect of the invention, a suspended ceiling system includes a plurality of main-tee beams disposed substantially parallel to each other, and a plurality of cross-tee beams disposed substantially parallel to each other and perpendicular to the main-tee beams. The beams form a ceiling grid system which defines grid openings. A ceiling panel is installed in each grid opening, and each ceiling panel has a flat main portion and peripheral wall portions extending substantially perpendicularly to the main portion. A plurality of lock-down clips are also provided, with each lock-down clip designed to secure two ceiling panels and one cross-tee beam to a main-tee beam.

Other features and advantages of the invention will be set forth in the following description made in connection with the accompanying drawings in which like reference characters refer to similar parts throughout the several views.

DESCRIPTION OF THE PREFERRED EMBODIMENTS

Figure 1:
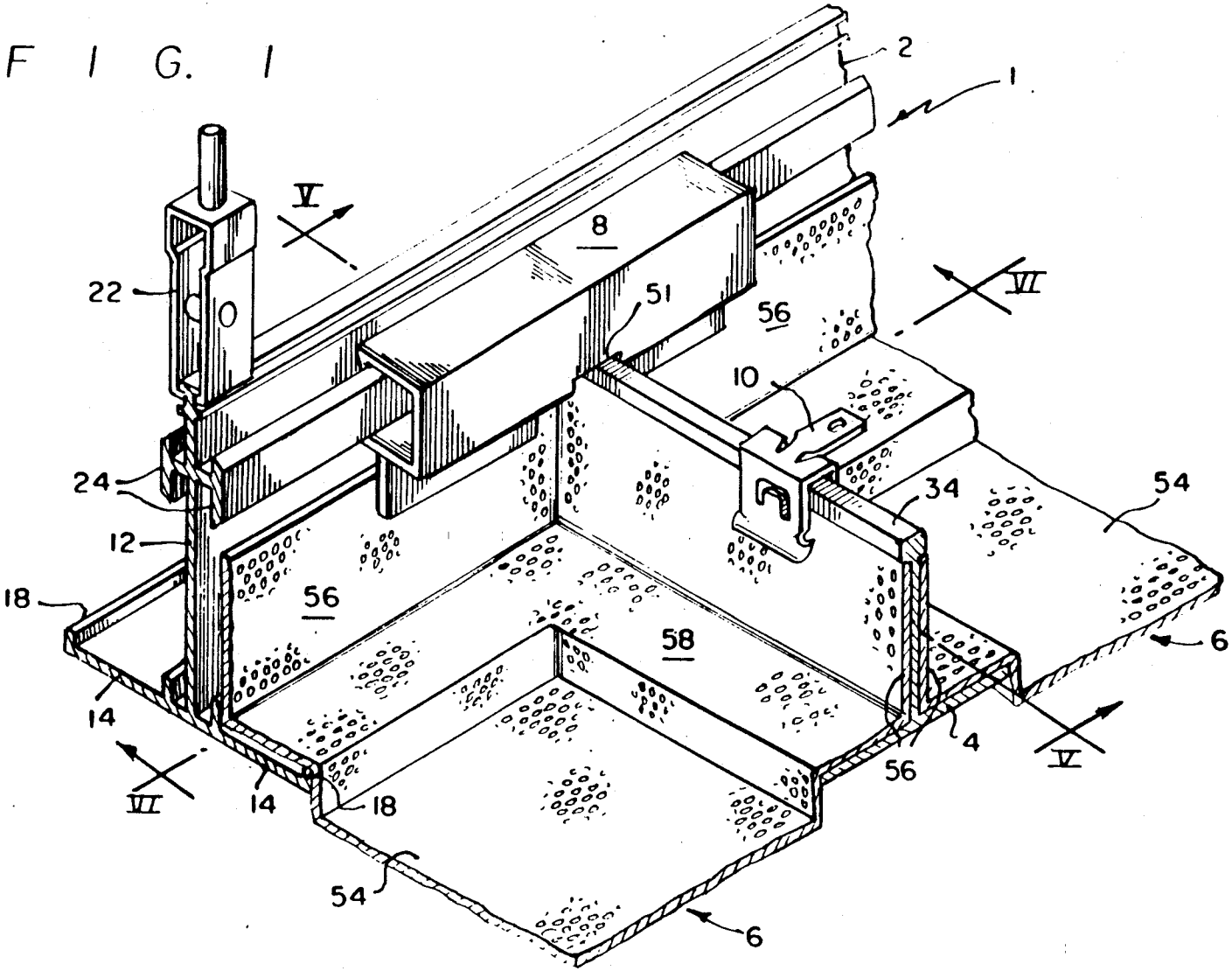
FIG. 1 is a partial perspective view of a ceiling system in accordance with a preferred embodiment of the present invention.

A suspended ceiling system of the type comprising the invention is indicated generally by the reference numeral 1 and is illustrated in FIG. 1. The partial view of FIG. 1 shows a main-tee beam 2 and a perpendicularly extending cross-tee beam 4. The main-tee beam 2 and cross-tee beam 4 are part of a ceiling grid (that will be explained in further detail below) formed to support ceiling panels 6. A lock-down, or retaining clip 8 secures the cross-tee beam and the ceiling panels to the main-tee beam. A panel clip 10 secures two ceiling panels 6 to the cross-tee beam.

Figure 2:
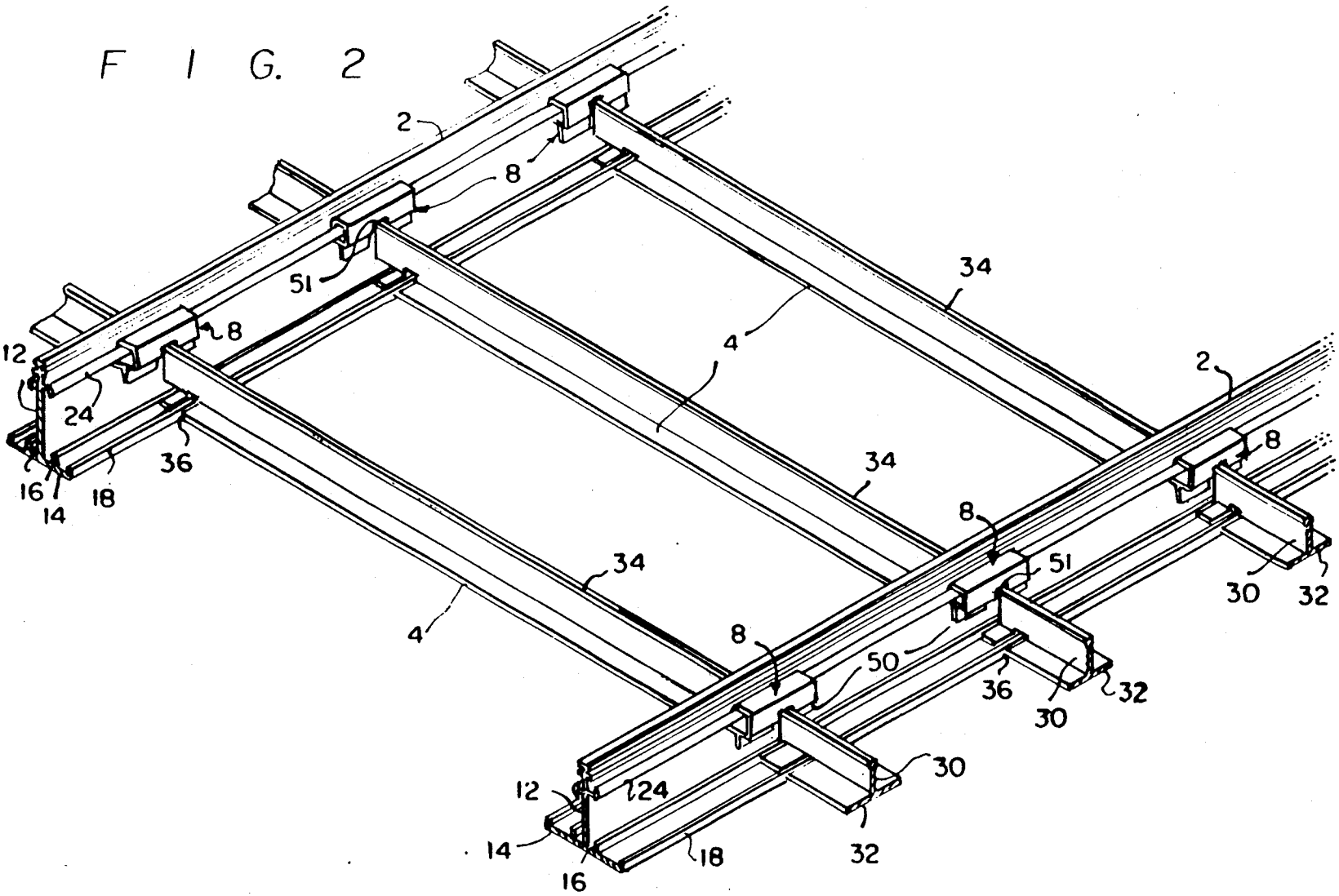
FIG. 2 is an isometric view of a ceiling grid system in accordance with this preferred embodiment.

The ceiling grid, shown in FIG. 2, provides a plurality of main-tee beams 2 and cross-tee beams 4 secured together to define a plurality of grid openings 3. Typically, the main-tee beams are disposed in parallel to each other and perpendicularly to the cross-tee beams to form square or rectangularly-shaped grid openings. However, the ceiling grid can be constructed to form grid openings of various shapes without departing from the scope of the invention. The lock-down clips 8 shown in FIG. 2 can be temporarily used to secure the ceiling grid, although they are removed to insert the ceiling panels 6 within the grid openings 3. As shown in FIG. 1, the main-tee beams can be suspended from a hanger assembly 22 in a known manner.

Figure 3:
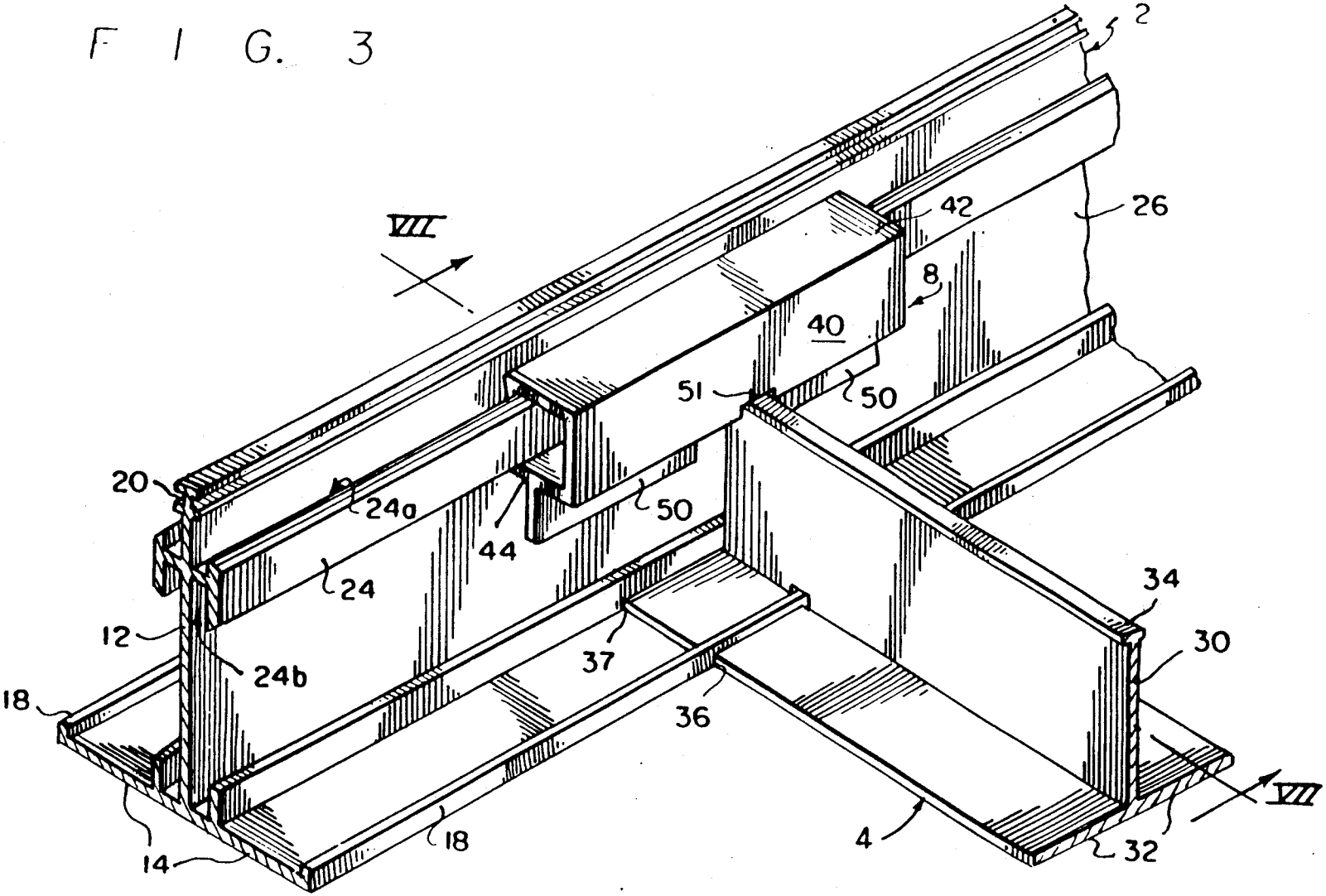
FIG. 3 is an enlarged partial view of FIG. 2.

With reference to FIG. 3, the main-tee beam 2 has a primary vertical extension 12 having at its lower end two secondary extensions 14 which extend in opposite directions from each other and in a direction perpendicular to the primary extension. Each secondary extension includes a spacer bar 16 and an upturned lip !8 at its distal end. The spacer bar and upturned lip are used for reasons which will become apparent when the assembly of the ceiling system is discussed. The upper end of the primary extension has a dual-sided notched portion 20 for receiving the hanger assembly 22 as shown in FIG. 1. The primary extension also includes a channel guide 24, disposed immediately below the notched portion 20, formed on both side surfaces 26. The channel guide 24 forms an upwardly facing upper channel 24*a* and downwardly facing lower channel 24*b* along the side surfaces of the primary extension.

Figure 6:
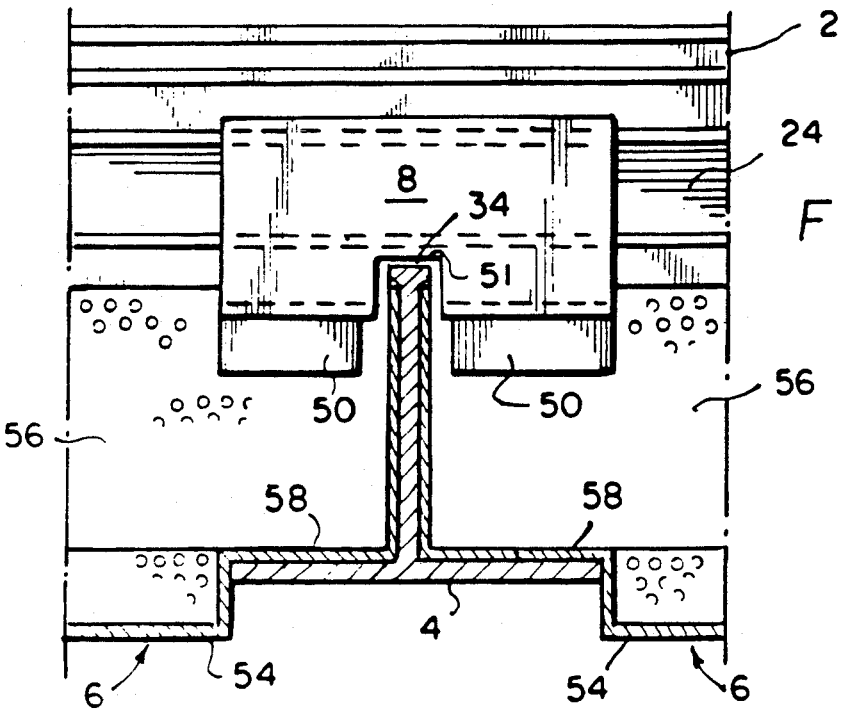
FIG. 6 is a cross-sectional view taken along plane 6—6 in FIG. 1.
Figure 7:
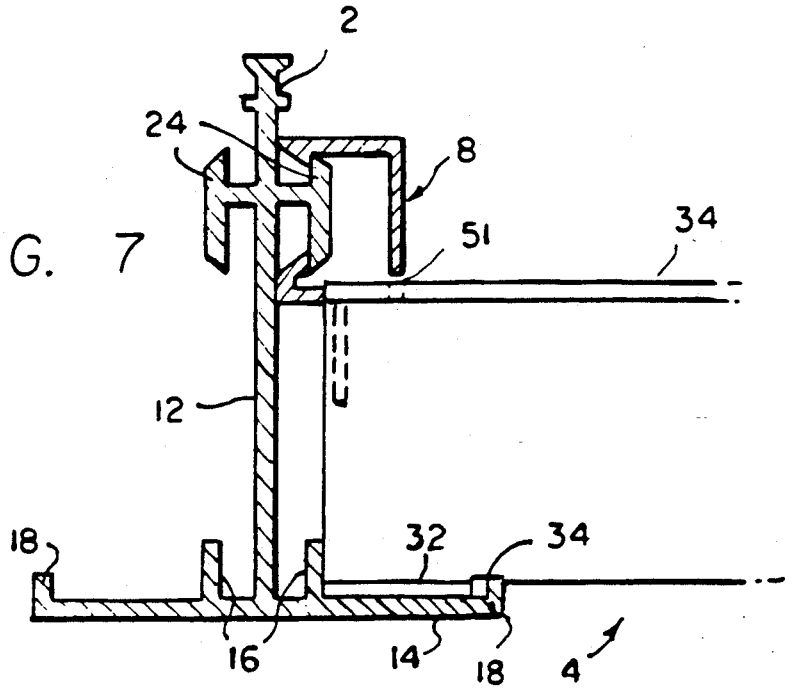
FIG. 7 is a cross-sectional view taken along plane 7—7 in FIG. 3.

The cross-tee beam 4 has an inverted substantially "T-shaped" cross-section and includes a vertical leg 30 and two horizontal legs 32 extending in opposite directions from the lower end of the vertical leg as shown in FIG. 3. The upper end of the vertical leg forms a horizontal ridge portion 34 which is received in the lock-down clip 8 as shown in FIG. 6. The cross-tee beams also include locking grooves 36 disposed proximate to each horizontal end 37 and extending through the horizontal legs 32 and a portion of the vertical leg 30. The locking grooves are designed to receive the upturned lip 18 of the secondary extension 14 of the main-tee beam as best seen in FIG. 7 and prevent longitudinal movement of the cross-tee beams with respect to the main-tee beams.

Figure 4:
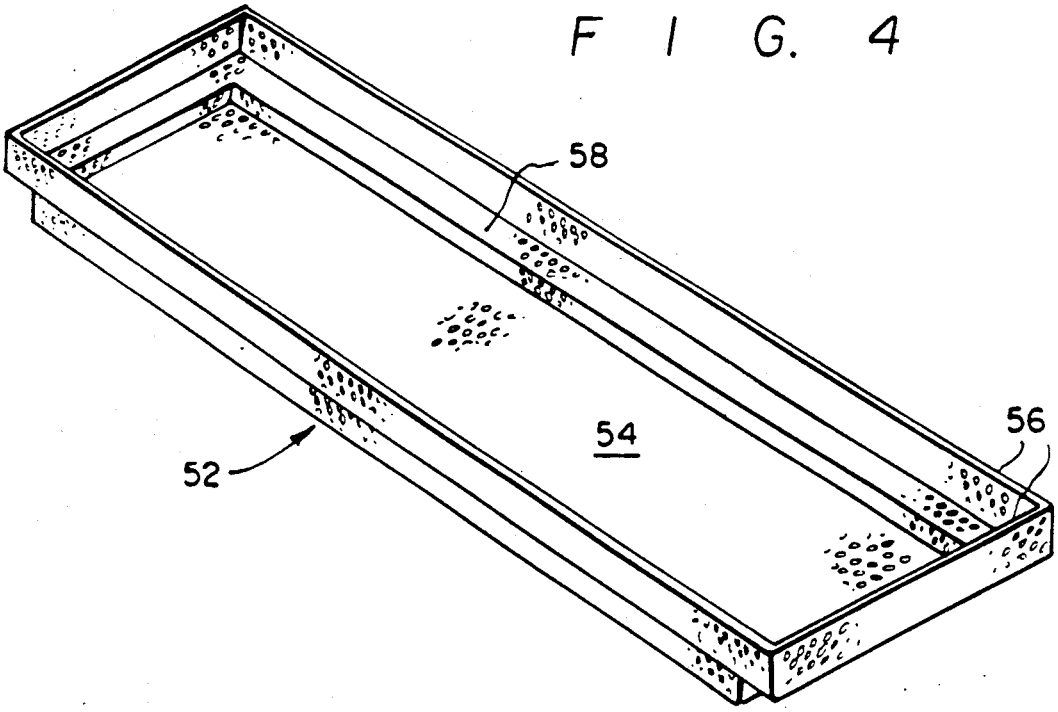
FIG. 4 is a perspective view of a ceiling panel in accordance with this preferred embodiment.

FIG. 4 shows one type of ceiling panel 52 to be used in the invention. The ceiling panel has a flat main portion 54 and upwardly extending peripheral wall portion 56. The ceiling panel illustrated in FIG. 4 includes a step portion 58 adjoining the main portion with the peripheral edges. However, this step portion is optional, and a ceiling panel without that feature can be used in the invention. Other variations of ceiling panels, such as a back panel used for improved acoustical response, are within the scope of this invention.

Figure 5:
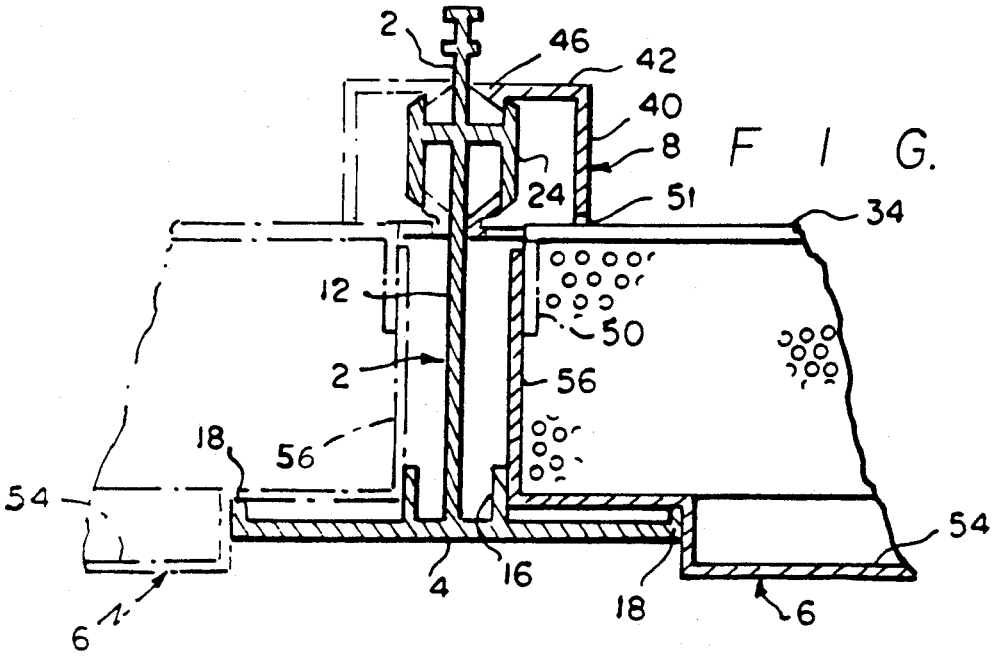
FIG. 5 is a partial cross-sectional view taken along plane 5—5 in FIG 1.

As shown, for example, in FIGS. 3 and 5, the lock-down clip 8 is generally in the shape of a c-shaped channel with a back portion 40 and upper and lower legs 42, 44 respectively. The upper leg 42 has a beaded tip 46 and the lower leg has a hook-shaped end 48, both of which are designed to snap-fit into the upper 24*a* and lower 24*b* channels, respectively, of the channel guide 24 on the main-tee beam. Of course, the upper and lower legs can have differently shaped ends as long as they can be securely fitted into the channels. The lock-down clip also includes a tab portion 50 extending downwardly from the lower leg portion. As shown in FIG. 5, the tab portion is positioned flush against the inside peripheral wall portion 56 of the ceiling panel when the ceiling system is assembled. In addition, a locking notch 51 as shown in FIG. 6 is provided for receiving the ceiling panel and the cross-tee beam.

Figure 8:
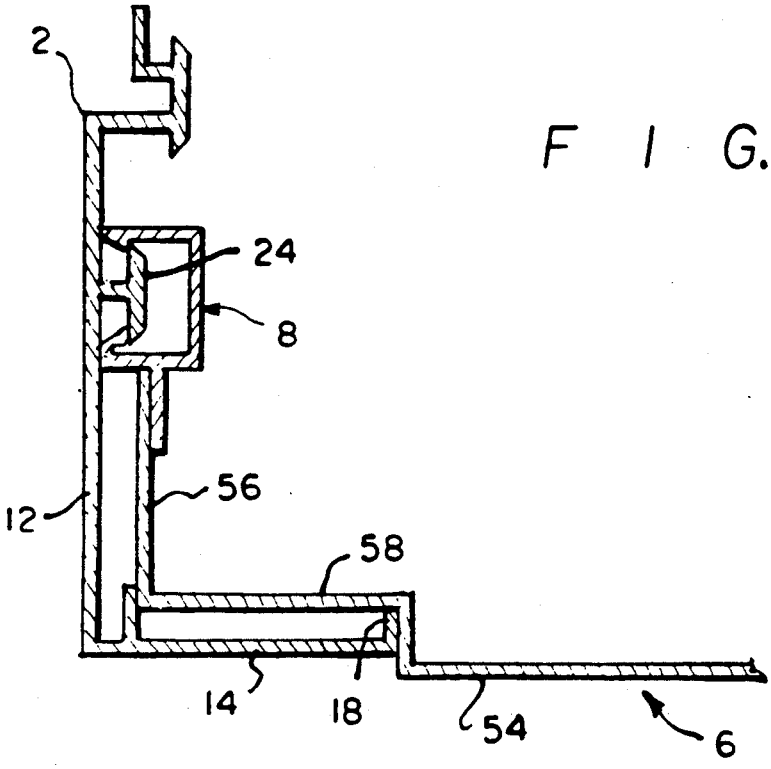
FIG. 8 is an perimeter cross-sectional view with a standard ceiling panel.

To assemble the ceiling system, the ceiling grid is formed by hanging the main-tee beams from hanger assemblies 22. The cross-tee beams 4 are then placed on the secondary extensions, suspended main-tee beams 42, of the locking grooves 36 of the cross-tee beams receiving the upturned lips 18 of the main-tee beams and the horizontal ends 37 abutting the spacer bars 16. Main-tee beams having two secondary extensions 14 are used in the interior of the ceiling grid. However, main-tee beams positioned on the perimeter of the ceiling grid are formed with only a single extension 14 as shown in FIG. 8. Likewise, the cross-tee beams need only a single horizontal leg 32 when positioned on the perimeter of the ceiling grid.

A ceiling panel 6 is inserted into each ceiling grid opening. As illustrated in FIG. 1, the ceiling panel is supported primarily by the secondary extension 14 of the main-tee beam 2 and the horizontal leg 32 of the cross-tee beam 4. The ceiling panel should also peripherally abut the spacer bar !6 and the vertical leg 30 of the cross-tee beam.

The lock down clip 8 is snap-fit onto the channel guide 24 of the main-tee beam as shown in FIG. 5 to secure the cross-tee beam 4 and two ceiling panels 6 to the main beam 2. The cross-tee beam is securely fastened by virtue of the upturned lip 18 of the main beam being inserted into the locking groove 36 of the cross-tee beam and the horizontal ridge portion 34 disposed within the locking notch 51 of the lock down clip 8. The peripheral edges of the ceiling panels running in the direction of the cross-tee beams are received beneath the ridge elements 34 and are disposed within the locking notch 51, and the tab portion 50 of the lock down clip is flush against the inside surface of the peripheral edges running in the direction of the main-tee beams. For further security, a ceiling panel clip 10 clips two ceiling panels to the vertical leg 30 of the cross-tee beam.

Figure 9:
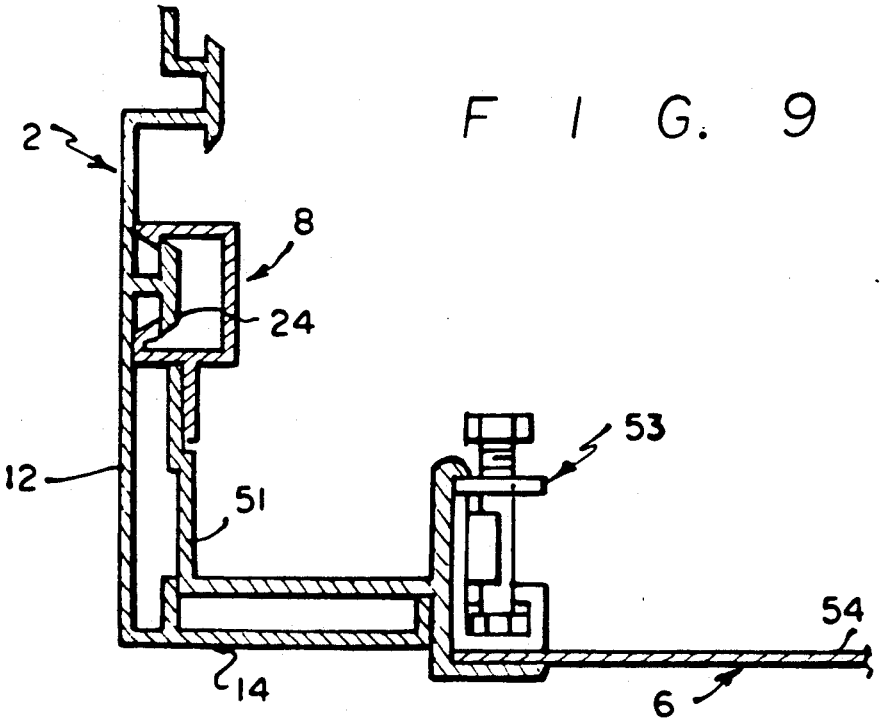
FIG. 9 is a perimeter cross-sectional view with a cut ceiling panel.

The ceiling grid openings are sized to receive a standard size ceiling panel. However, ceiling grid openings on the periphery of the ceiling grid are sometimes shaped differently due to the dimensions of the ceiling. In such situations, the ceiling panels must be cut to fit into the peripheral ceiling grid openings. FIG. 9 shows a perimeter portion of the ceiling grid designed to accommodate a cut ceiling panel. Instead of securing a peripheral edge of the ceiling panel, the lock down clip 8 secures a flat-panel adapter 51. A flat-panel clamp 53 is fixedly secured to an end of the adapter and clamps a flat portion of the ceiling panel between the clamp 53 and the adapter 51.

While the preferred form of the invention has been illustrated and described above, it should be understood that the invention can be modified without departing from the spirit and scope of the invention. Thus, the scope of the invention is to be defined by the applied claims. For example, the ceiling system described above can be used wherever an easy-to-assemble ceiling is desired and is not limited to a high security ceiling system.

What is claimed is:

1. A suspended ceiling system, comprising:

a plurality of main-tee beams disposed substantially parallel to each other;

a plurality of cross-tee beams disposed substantially parallel to each other and substantially perpendicular to said plurality of main-tee beams to form a ceiling grid system defining a plurality of grid openings;

a ceiling panel disposed in each grid opening within said grid system, said ceiling panel having a flat main portion and upwardly projecting peripheral wall portions extending substantially perpendicular to said main portion; and a plurality of retaining lockdown clips, with each retaining lockdown clip securing at least one ceiling panel and one of said cross-tee beams to one of said main-tee beams.

2. A suspended ceiling system according to claim 1, further comprising a panel clip for securing two of said ceiling panels to one of said cross-tee beams.

3. A suspended ceiling system according to claim 1, wherein said . has upper and lower legs extending in substantially the same direction from a back portion, with said upper and lower legs having end portions to be secured to said main-tee beams.

4. A suspended ceiling system according to claim 3, wherein said lock-down clip includes a locking notch in said back portion for receiving said cross-tee beam and peripheral wall portion of said ceiling panel.

5. A suspended ceiling system according to claim 4, wherein said clip further includes downwardly extending tabs for pressing against said peripheral wall portions of said ceiling panel.

6. A suspended ceiling system according to claim 5, wherein each said retaining lockdown clip secures two of said ceiling panels and one of said cross-tee beams to one of said main-tee beams.

7. A suspended ceiling system according to claim 6, wherein each of said main-tee beams comprises a primary vertical extension having upper and lower ends and at least a first secondary extension extending horizontally and substantially perpendicular to said lower end of said primary extension.

8. A suspended ceiling system according to claim 7, wherein said main-tee beam further comprises a second secondary extension disposed opposite from said first secondary extension and extending substantially perpendicular to said primary extension.

9. A suspended ceiling system according to claim 8, in which said first and second secondary extensions further comprise an upturned lip portion at their distal ends and a spacer bar extending substantially parallel with said primary extension, wherein the end of each cross-tee beam is positioned to abut a said spacer bar, and wherein a locking groove is provided adjacent each end of said cross-tee beams for being received over said upturned lip portion of said main-tee extension to prevent longitudinal movement of said cross-tee beams.

10. A suspended ceiling system according to claim 9, wherein said primary extension of each said main-tee beam comprises a first channel forming means for forming opposed first and second channels, one facing upward and one downward, with said channel forming means being disposed on one side of said primary extension for receiving said end portions of said retaining lockdown clips respectively within said first and second channels.

11. A suspended ceiling system according to claim 10, wherein said primary extension comprises a second channel forming means disposed opposite to said first channel forming means and forming first and second channels for receiving end portions of said retaining lockdown clips.

12. A suspended ceiling system according to claim 11, wherein said end portions of said retaining lockdown clips are snap-fitted into said channel forming means.

13. A suspended ceiling system according to claim 12, wherein each of said cross-tee beams has a vertically extending leg connected at a lower end to at least one horizontally extending leg.

14. A suspended ceiling system according to claim 13, wherein said ceiling panel includes a stepped portion connecting said flat portion and said peripheral wall portions.

15. A suspended ceiling system, comprising:

ceiling grid means for defining a plurality of grid openings, said grid means comprising a plurality of first and second perpendicularly disposed beams;

ceiling panels supported by said first and second beams in each said grid opening, said ceiling panels including a flat portion and upwardly extending peripheral wall portions; and retaining interlocking clip means for locking together one each of said first and second beams and at least one ceiling panel.

16. A suspended ceiling system according to claim 15, wherein said first beams include channel forming means for forming a plurality of channels, and said interlocking clip means includes first and second leg portions for snap-fitting into said plurality of channels.

17. A suspended ceiling system according to claim 16, wherein said retaining interlocking clip means includes a locking notch portion for receiving an end portion of a said second beam and said wall portions of a pair of said ceiling panels and preventing lateral movement of said second beam and said ceiling panels in a first direction, and further includes downwardly extending tabs pressing against said wall portions and preventing lateral movement of said ceiling panels in a second direction.

18. A suspended ceiling system according to claim 17, wherein the ends of said second beams include a locking groove and said first beams include a lip portion fitting into said locking groove and preventing longitudinal movement of said second beams.

19. A suspended ceiling system according to claim 18, further comprising panel clips for securing said wall portions of first and second ceiling panels to opposite sides of said second beams.

* * * * *

UNITED STATES PATENT AND TRADEMARK OFFICE

CERTIFICATE OF CORRECTION

PATENT NO. : 5,077,951

DATED : January 7, 1992

INVENTOR(S) : ROBERT F. BAKER

It is certified that error appears in the above-identified patent and that said Letters Patent is hereby corrected as shown below:

ON THE TITLE PAGE:

IN [56] REFERENCES CITED

U.S. PATENT DOCUMENTS, "2,481,794 2/1945 Stitt" should read --2,481,794 9/1949 Stitt-- and "3,216,537 5/1966 Nelsson" should read --3,216,537 11/1965 Nelsson--.

IN [57] ABSTRACT

Line 4, "retaining" should read --lockdown--.

COLUMN 2

--lockdown clip 8--.
Line 62, "upturned lip !8" should read --upturned lip 18--.

COLUMN 3

Line 23, "portion" should read --portions--.
Line 51, "extensions," should read --extensions 14 of the-- and "main-tee beams 42," should read --main-tee beams 2,--.
Line 52, "of" (first occurrence) should read --with--.
Line 67, "spacer bar !6" should read --spacer bar 16--.

COLUMN 4

Line 55, "retaining" should be deleted.
Line 56, "retaining" should be deleted.
Line 63, "said ." should read --said lockdown clip--.

UNITED STATES PATENT AND TRADEMARK OFFICE

CERTIFICATE OF CORRECTION

PATENT NO. : 5,077,951

DATED : January 7, 1992

INVENTOR(S) : ROBERT F. BAKER

It is certified that error appears in the above-identified patent and that said Letters Patent is hereby corrected as shown below:

COLUMN 5

Line 8, "retaining" should be deleted.
Line 39, "retaining" should be deleted.
Line 46, "retaining" should be deleted.

COLUMN 6

Line 2, "retaining" should be deleted.
Line 20, "retaining" should be deleted.
Line 29, "retaining" should be deleted.

Signed and Sealed this

Twenty-eighth Day of June, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,077,951

DATED : January 7, 1992

INVENTOR(S) : ROBERT F. BAKER

It is certified that error appears in the above-identified patent and that said Letters Patent is hereby corrected as shown below:

ON THE TITLE PAGE:

IN [56] REFERENCES CITED

U.S. PATENT DOCUMENTS, "2,481,794 2/1945 Stitt" should read --2,481,794 9/1949 Stitt-- and "3,216,537 5/1966 Nelsson" should read --3,216,537 11/1965 Nelsson--.

IN [57] ABSTRACT

Line 4, "retaining" should read --lockdown--.

COLUMN 2

Line 38, "lock-down, or retaining clip 8" should read --lockdown clip 8--.
Line 62, "upturned lip !8" should read --upturned lip 18--.

COLUMN 3

Line 23, "portion" should read --portions--.
Line 51, "extensions," should read --extensions 14 of the-- and "main-tee beams 42," should read --main-tee beams 2,--.
Line 52, "of" (first occurrence) should read --with--.
Line 67, "spacer bar !6" should read --spacer bar 16--.

COLUMN 4

Line 55, "retaining" should be deleted.
Line 56, "retaining" should be deleted.
Line 63, "said ." should read --said lockdown clip--.

UNITED STATES PATENT AND TRADEMARK OFFICE

CERTIFICATE OF CORRECTION

PATENT NO. : 5,077,951

DATED : January 7, 1992

INVENTOR(S) : ROBERT F. BAKER

It is certified that error appears in the above-identified patent and that said Letters Patent is hereby corrected as shown below:

COLUMN 5

Line 8, "retaining" should be deleted.
Line 39, "retaining" should be deleted.
Line 46, "retaining" should be deleted.

COLUMN 6

Line 2, "retaining" should be deleted.
Line 20, "retaining" should be deleted.
Line 29, "retaining" should be deleted.

This certificate supersedes Certificate of Correction issued June 28, 1994.

Signed and Sealed this

Third Day of January, 1995

Bruce Lehman

*Attest:*

BRUCE LEHMAN

*Attesting Officer*

*Commissioner of Patents and Trademarks*